US007255505B1

(12) United States Patent
Peterson

(10) Patent No.: US 7,255,505 B1
(45) Date of Patent: Aug. 14, 2007

(54) LIQUID APPLICATOR ASSEMBLY

(76) Inventor: James Peterson, 944 Locust Dr., Apt. 1F, Sleepy Hollow, IL (US) 60118

( * ) Notice: Subject to any disclaimer, the term of this patent is extended or adjusted under 35 U.S.C. 154(b) by 402 days.

(21) Appl. No.: 10/930,278

(22) Filed: Aug. 31, 2004

(51) Int. Cl.

| | |
|---|---|
| ***A46B 5/02*** | (2006.01) |
| ***A46B 11/00*** | (2006.01) |
| ***B43K 7/10*** | (2006.01) |
| ***B43M 11/02*** | (2006.01) |

(52) U.S. Cl. ..... 401/6; 401/147; 401/218; 401/219; 401/4

(58) Field of Classification Search ..... 401/6, 401/147, 208, 218, 219, 220, 4
See application file for complete search history.

(56) References Cited

U.S. PATENT DOCUMENTS

| | | | | | |
|---|---|---|---|---|---|
| 154,195 | A | * | 8/1874 | Smith | 401/208 |
| 3,138,814 | A | * | 6/1964 | Carrona | 15/98 |
| 4,627,758 | A | * | 12/1986 | Winthrop | 401/208 |
| 4,767,229 | A | * | 8/1988 | Cha | 401/208 |
| 5,277,509 | A | * | 1/1994 | Danehy | 401/208 |

* cited by examiner

*Primary Examiner*—David J. Walczak
(74) *Attorney, Agent, or Firm*—Mathew R. P. Perrone, Jr.

(57) ABSTRACT

A liquid applicator assembly has a housing with a liquid storage and a dispensing roller fed by a continuos belt in housing, so that liquid may be applied evenly to a surface. This applicator assembly is especially useful for applying lotion to the skin of a person without any lotion or with minimal lotion coming into contact with a person's hands.

14 Claims, 4 Drawing Sheets

LIQUID APPLICATOR ASSEMBLY

This invention relates to a liquid applicator, and more particularly, to a liquid applicator assembly that applies an even and a wide film to a surface, especially an even and a wide film of lotion on any part of a person's body.

BACKGROUND OF THE INVENTION

Many areas require an even and wide film of liquid to be applied to a surface. Typical of such uses are paint to an inanimate surface and lotion to human skin. While the discussion below relates to skin and lotion therefor, simple extrapolation indicates applicability to other liquids and surfaces.

When a person works outdoors or seeks to enjoy the outdoors, exposure to the sun may cause sunburn on the skin of the person. Prolonged exposure to the sun may also cause skin cancer. One method to prevent harmful exposure to the sun is to apply a protective lotion, commonly known as sun screen, to a person's skin.

Individuals with arthritis, such as the elderly, may have difficulty opening and closing containers typically used to contain lotions that are applied to the skin of a person. Medical personnel that care for the sick or elderly may also need to apply lotion to the skin of individuals.

An additional problem occurs when a person is working outdoors or is at the beach and desired to apply a sun screen by hand, and yet sand or dirt is present on the hands of the person. If a person puts a sun screen on an appendage, such as a hand, and sand or dirt is present also, applying the sun screen on that body part will feel rough, scratchy, and uncomfortable. If applying a sun screen to a body feels uncomfortable, a person may be unwilling to apply a sun screen on the skin. This decrease in willingness to apply a sun screen to a body may result in harmful effects to the skin of a person such as the relatively minor sunburn or the more serious skin cancer.

Then there are certain types of tanning lotion, which provide a quick appearance for a tan. Any of this type of a lotion is difficult to use. If any of it is left on any portion of skin, the appearance of a tan results. Such an appearance is not desired in all case, such as on a person's hands.

Also, it is difficult to have a manageable large supply of such viscous lotion available. The container is difficult to handle and the flow of the lotion therefrom is difficult to control. Improved control of a large quantity of lotion is very desirable.

Many times, a lotion can separate into its components. Shaking does not completely solve the problem. It is very desirable to provide some device or method, in order to keep the lotion properly mixed as it is applied.

Another problem occurs when a person desires to apply a sun screen on difficult-to-reach locations on the body. Yet another problem occurs when a person is handling food and does not desire to have the same hands come into contact with sun screen lotion. Both of these problems may also decrease the willingness of a person to apply a sun screen to the skin of a body.

Additionally, another problem occurs when a person having difficulty using the hands attempts to open a container and apply lotion to the body. If opening a container is difficult for an individual, the person may not be willing to apply lotion to skin needing medical attention. If the lotion is not applied to the skin, deterioration or harmful effects to the skin may occur.

And yet another problem occurs when medical personnel wanting to apply lotion to a sick or elderly person do not want a lotion to come into contact with the hands. If such a person uses rubber gloves to isolate the hands from a lotion, time and effort to perform this task increase. As time and effort increases, productivity may decrease. If such a person does not use rubber gloves and applies the lotion to a sick or elderly individual, germs and bacteria may be transferred to the patient.

SUMMARY OF THE INVENTION

Among the many objectives of this invention is the provision of a lotion applicator, which allows a person working outdoors or at the beach with dirty hands to apply lotion on a body without the lotion coming into contact with the hands.

A further objective of this invention is the provision of a lotion applicator, which allows for the application of lotion to difficult-to-reach locations on a body.

Yet a further objective of this invention is the provision of a lotion applicator, which allows a person handling food to apply lotion to a body without the lotion coming into contact with the hands.

A still further objective of this invention is the provision of a lotion applicator, which allows a person having difficulty using the hands to apply lotion to a body without having to open and close a typical lotion containing container.

Another objective of this invention is the provision of a lotion applicator, which allows for medical personnel to apply lotion to sick or elderly persons and yet not have to put on rubber gloves to do so.

Yet another objective of this invention is the provision of a lotion applicator, which allows for a large supply of lotion to be available for application.

Still, another objective of this invention is the provision of a lotion applicator, which allows for controlling the flow from a large supply of lotion to be available for application.

Also an objective of this invention is the provision of a lotion applicator, which allows for a large supply of lotion to be properly mixed.

A further objective of this invention is the provision of a lotion applicator, which allows a person working outdoors or at the beach with dirty hands to apply lotion on a body with minimal lotion coming into contact with the hands.

Yet a further objective of this invention is the provision of a lotion applicator, which allows a person handling food to apply lotion to a body with minimal lotion coming into contact with the hands.

Yet a further objective of this invention is the provision of a lotion applicator, which allows a person handling food to apply lotion to a body with minimal lotion coming into contact with the hands.

Another objective of this invention is the provision of a liquid applicator, which allows a person to apply, which allows a person handling food to apply liquid to a surface with minimal liquid coming into contact with the hands.

Yet another objective of this invention is the provision of a liquid applicator, which allows for a large supply of liquid to be available for application.

Still, another objective of this invention is the provision of a lotion applicator, which allows for controlling the flow from a large supply of liquid to be available for application.

Also an objective of this invention is the provision of a lotion applicator, which allows for a large supply of liquid to be properly mixed.

These and other objectives of the invention (which other objectives become clear by consideration of the specification, claims and drawings as a whole) are met by providing a lotion applicator that allows lotion to be applied evenly to the skin of a person without any lotion or with minimal coming into contact with a person's hands or liquid to be applied to a surface efficiently.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
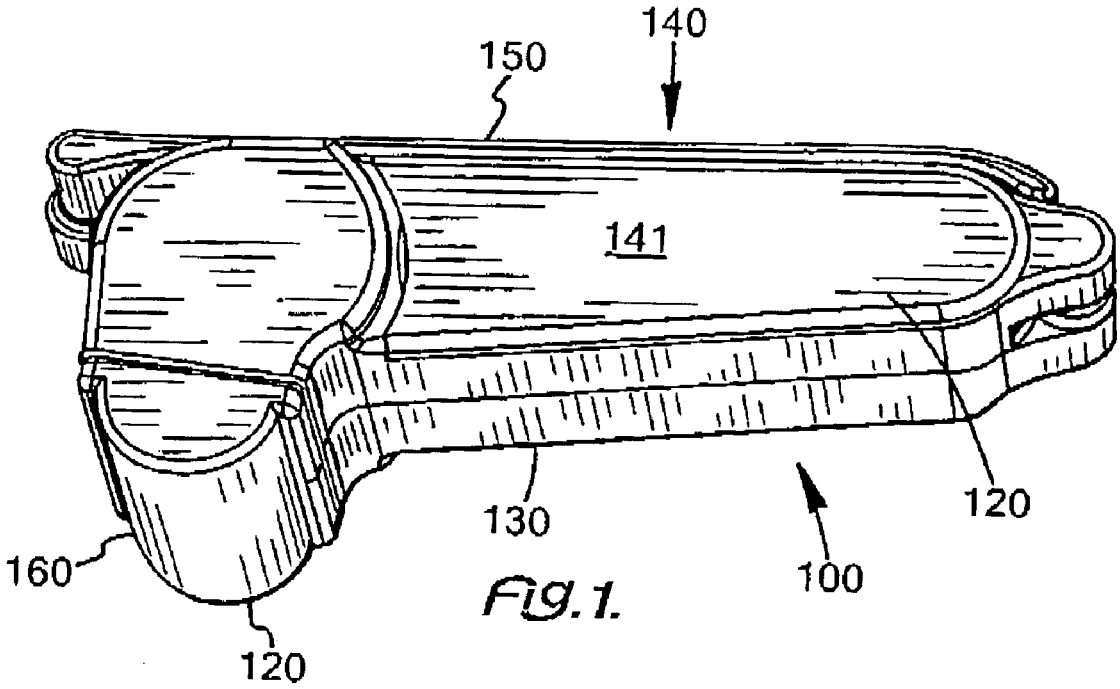
FIG. 1 depicts a perspective view of a lotion applicator assembly 100.

With the lotion applicator assembly, lotion is efficiently dispensed onto a body without any, or with minimal, lotion coming into contact with hands. The lotion applicator assembly also allows lotion to be applied to difficult-to-reach places on a body and for the lotion to be applied uniformly.

As a liquid, such as paint, can be applied to a surface with great efficiency. Thus, the lotion applicator assembly has more than one use. While references are mostly to the preferred lotion, the discussion is also applicable to paint or other fluids.

Within a housing for the lotion applicator assembly is a belt applicator. As the belt applicator moves through the lotion, both a spreading effect and a mixing effect occur. The mixing effect of the belt eliminates the separation of the lotion in a more efficient manner than shaking the bottle. Also, such movement permits the lotion to be spread in a fixed and even amount on the belt, which is then transferred to a roller, in order to allow an even application of lotion onto the body.

The belt is a preferably a continuous belt. As the continuous moves about its rollers and the continuous assembly, it moves and agitates the lotion in the lotion applicator assembly. Such agitation efficiently keeps the liquid or lotion mixed and avoids separation thereof. It also feeds it efficiently to the roller and more efficiently empties the lotion applicator assembly and uses the lotion.

Because the roller is connected to the belt by a gear assembly, rotation of the roller moves the continuous belt through the lotion. As the continuous belt moves through the lotion, the lotion is both mixed and applied to the roller for distribution on the desired skin surface. Thus, the roller provides part of a dispensing means at a dispenser housing end of for the lotion applicator assembly.

The belt applicator uniformly transfers a desired amount of well-mixed lotion to the roller. The roller can rotate to apply a desired amount of lotion to a desired body surface. Also, the roller can be fixed and can be used to spread the set amount of dispensed lotion across the body.

With fixing of the roller or the rotation of the roller being easily adjusted by pressure on the roller, application of the lotion can be effective. If the roller is locked, smearing or dispersal of lotion takes place. When the fixed roller sticks to the skin, the roller can be freed and allowed to rotate, thereby allowing more lotion to flow.

This combination of the belt and the roller permits a more efficient use of the lotion. The belt keeps the lotion mixed and directed toward the roller. Also, the housing can be more efficiently emptied of the lotion in its well-mixed form. With the belt feeding the well-mixed lotion to the roller, the mixing of the lotion and emptying of the dispenser are especially effective.

While any type of handle can be use don the housing to complete the lotion applicator assembly, a foldable handle is preferred. The foldable handle has three sections in its preferred form. The first handle section is secured to the housing or molded as a part thereof. The middle handle section is attached at one end to housing or to the section of the handle molded as a part of the housing, and at the other end to the end section.

A snap fitting secures sections together and permits them to open with a slight arc by rotating from a closed position to an open position. The middle handle section with the first section may be sufficient so that one might not need the end handle section. However, the arc produced by the handle, with all sections open, provides for efficient application of the lotion.

Figure 2:
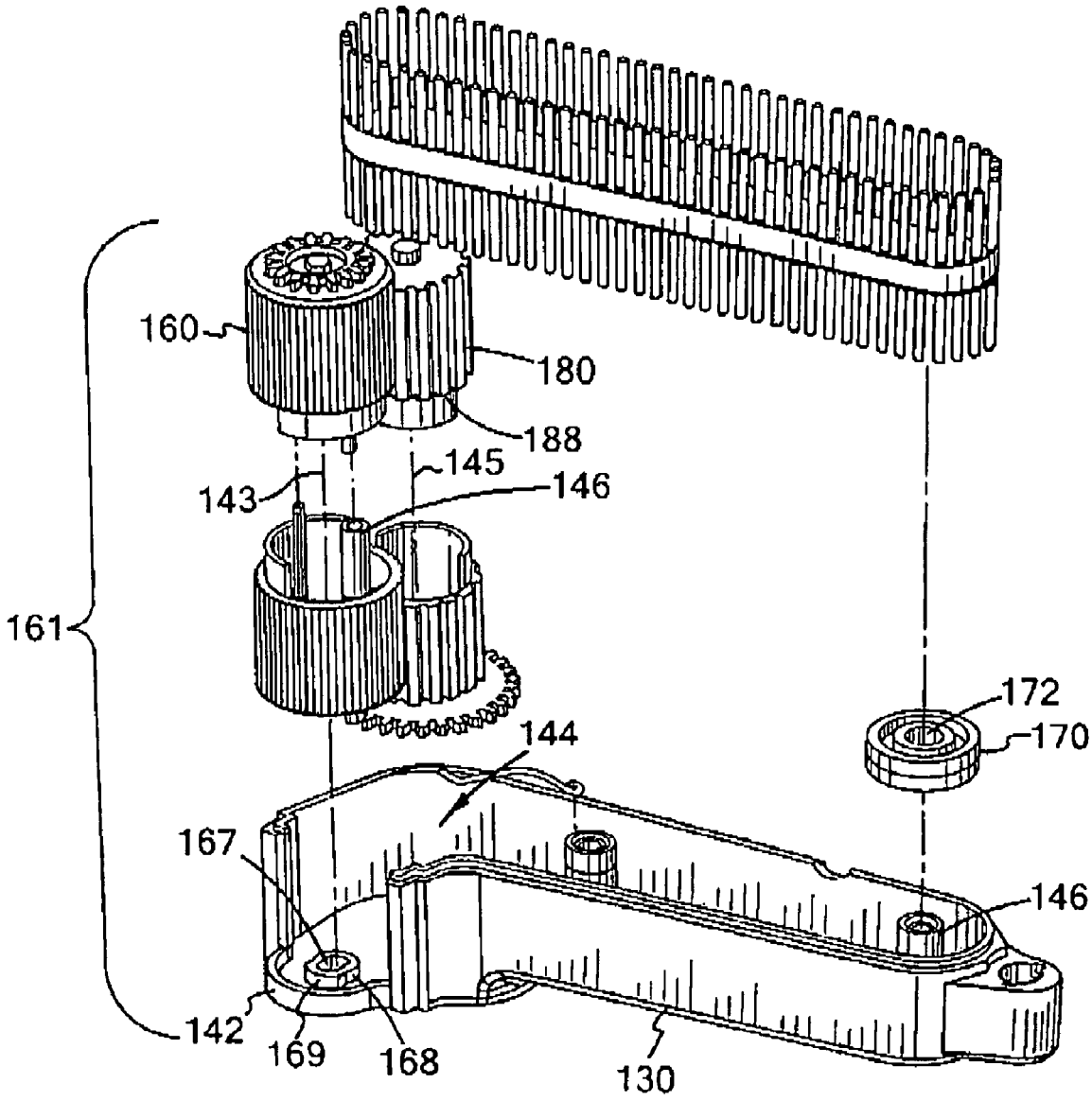
FIG. 2 depicts a perspective, partially cross-sectioned, exploded view of a lotion applicator assembly 100.

Referring now to FIG. 1 and FIG. 2, lotion applicator assembly 100 has a housing 140, with an outer applicator roll 160 and an inner applicator roll 180 mounted therein. Outer applicator roll 160 is mounted on outer roll housing stub 142 and inner applicator roll 180 is mounted on inner roll housing stub 144.

Outer applicator roll 160 is secured partially within housing 140. Inner applicator roll 180 is secured completely within housing 140, when first housing side 120 is attached to second housing side 130. Housing 140 also contains roller bearing 170. Roller bearing 170 contains roller bearing aperture 172 which receives housing shaft 146 of housing 140 and is thereby secured therein.

Figure 3:
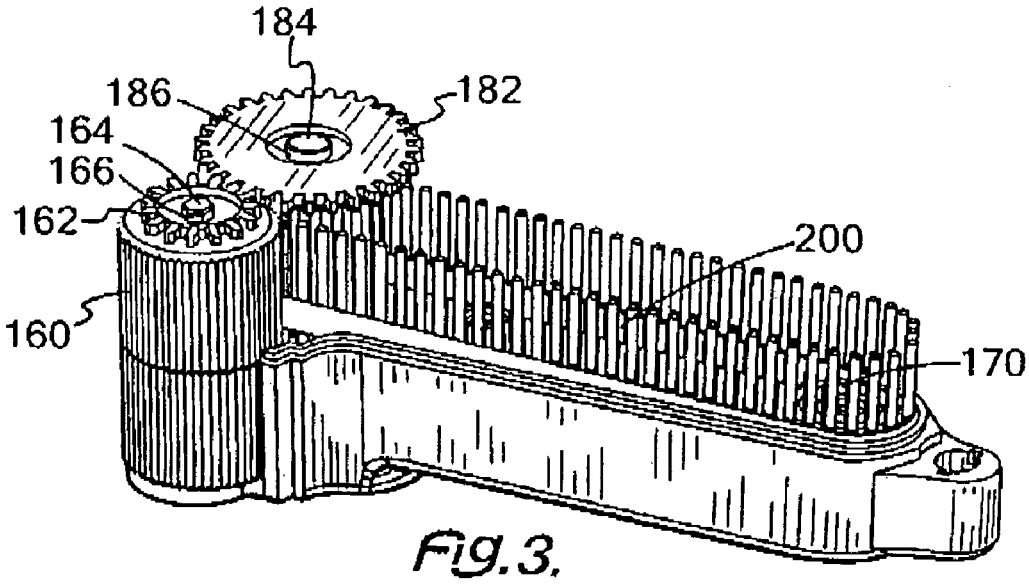
FIG. 3 depicts an assembled, perspective view of a lotion applicator assembly 100, based on FIG. 2.

Adding FIG. 3, outer roll gear 162 on outer applicator roll 160 starts gear assembly 161 by communicating with inner roll gear 182 on inner applicator roll 180. Outer roll gear 162 is attached to outer applicator roll 160 using outer roll bolt 164 which communicates with outer roll aperture 166. Inner roll gear 182 is attached to inner applicator roll 180 using inner roll bolt 184 which communicates with inner applicator roll aperture 186.

Outer applicator roll 160 and inner applicator roll 180 are cylindrical. Inner applicator roll 180 rotates within housing 140 and moves applicator drive belt 200. Outer applicator roll 160 both rotates on its longitudinal or cylindrical axis, and moves perpendicular thereto between a locked and an unlocked position.

Also, applicator drive belt 200 communicates with roller bearing 170 and applicator drive belt 200 communicates with inner applicator roll 180. Roller bearing 170 guides and aides in the movement of applicator drive belt 200. So when outer applicator roll 160 starts gear assembly 161 by communicating with inner roll gear 182 on inner applicator roll 180, applicator drive belt moves. Lotion in lotion chamber 156 is thus mixed and moved by applicator drive belt 200 to outer applicator roll 160.

Figure 4:
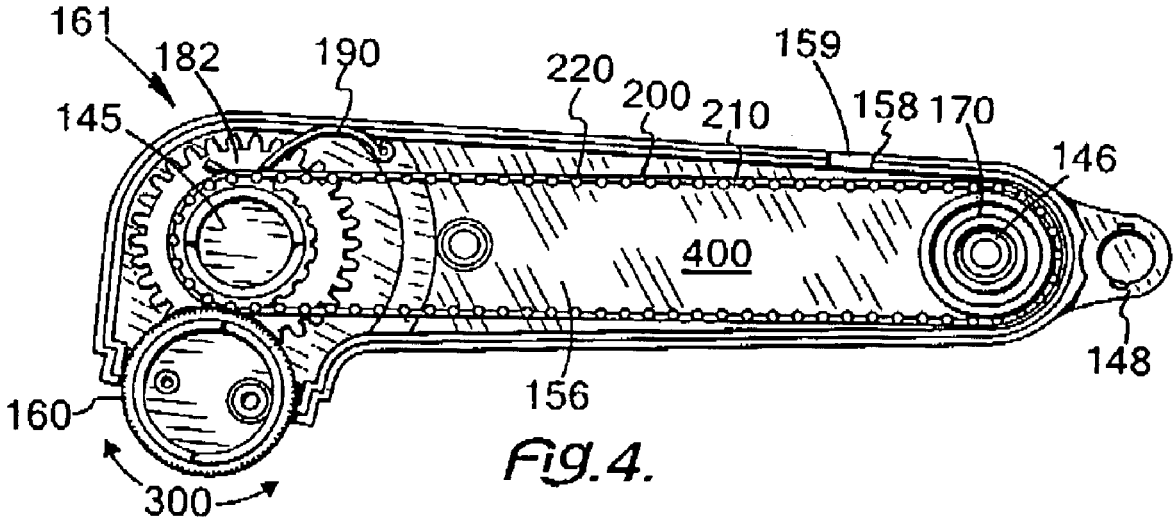
FIG. 4 depicts a side, cross-sectioned view of a lotion applicator assembly 100.

Turning now to FIG. 4, application of lotion 400 onto a body becomes clear. Lotion 400 is contained in lotion chamber 156 of housing 140. Handle housing end 148 is adjacent to lotion chamber 156. Within lotion chamber 156, is a lotion filling port 158 through which, a desired lotion 400 may be inserted. Lotion filling port 158 is releasably closed and sealed, or opened and accessible by stopper 159. Stopper 159 may be held in place on housing 140 by friction, threads or another appropriate device.

With communication between outer roll gear 162 and inner roll gear 182, a rotating or a rolling force 300 applied to outer applicator roll 160 causes rotation of roll 160 about outer roll stub axis 143 and rotation of inner applicator roll 180 about inner roll stub axis 145. Further, as inner applicator roll 180 turns, communication of inner roll slots 188 with drive belt fingers 220 of applicator drive belt 200 causes movement of belt 200 within housing 140.

When applicator drive belt 200 moves and lotion 400 is present within housing 140, the spacing 210 between drive belt fingers 220 of applicator drive belt 200 allows lotion 400 to be both mixed and transported by the belt 200 within housing 140. The arrival of lotion 400 within spacing 210 reaching outer applicator roll 160 results in lotion 400 being transferred to roll 160. Spring 190 within housing 140 ensures belt 200 stays in communication with inner applicator roll 180 and does not slip. If the rolling force 300 is caused by either pushing or pulling the lotion applicator assembly 100 across a body, lotion 400 is transferred to a person's body and in such a way lotion applicator assembly 100 can be used to apply lotion to a body without the lotion coming into contact with a hand.

Also, in FIG. 2, outer applicator roll 160 is slidably mounted in roll slot 167. Outer applicator roll 160 slides back and forth in roll slot 167. Roll slot 167 has a lock portion 168 and a rotating portion 169. Lock portion 168 locks outer applicator roll 160 and permits it to smear lotion. Rotating portion 169 allows outer applicator roll 160 to rotate about its cylindrical axis, to thereby dispense or apply more lotion. Outer applicator roll 160 is subject to pressure and therefore slidably mounted between lock portion 168 and rotating portion 169.

Figure 5:
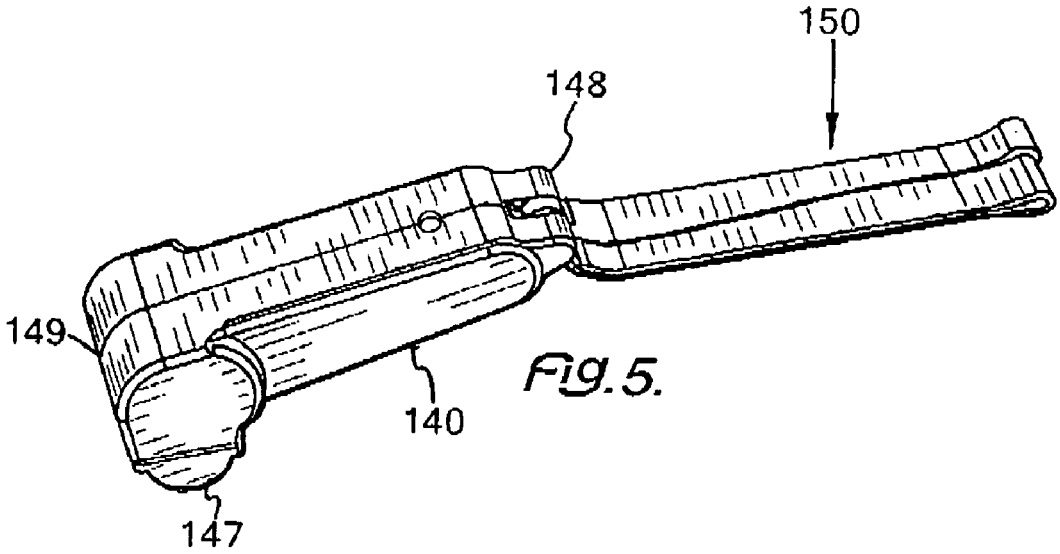
FIG. 5 depicts a perspective, partially extended view of handle assembly 150 on a lotion applicator assembly 100.
Figure 6:
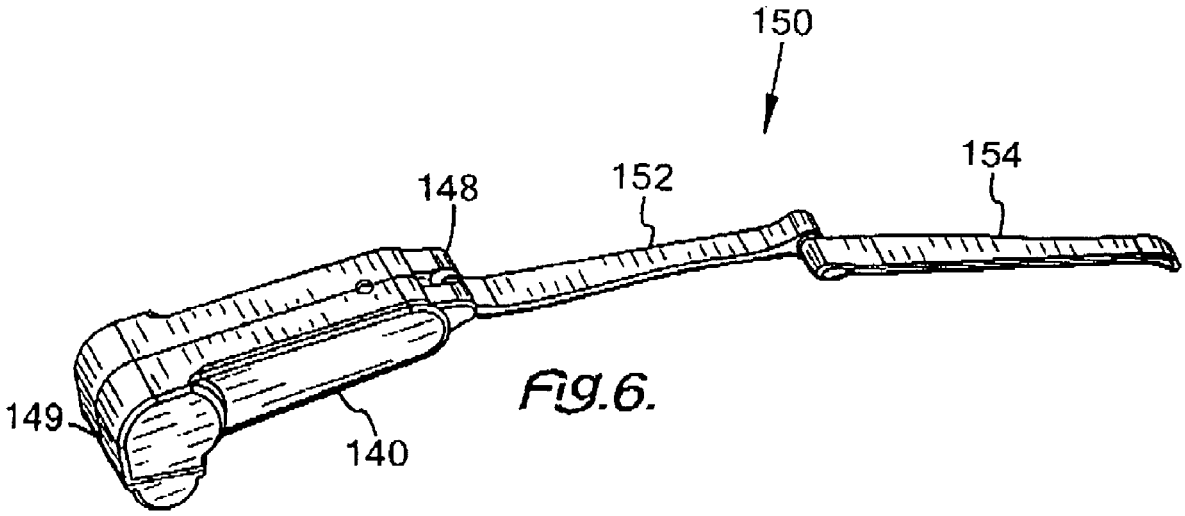
FIG. 6 depicts a perspective, fully extended view of handle assembly 150 on a lotion applicator assembly 100.

Adding now FIG. 5, FIG. 6 and FIG. 7, lotion applicator assembly 100 has handle assembly 150 attached to housing 140. Handle assembly 150 is attached to housing 140 at handle housing end 148 oppositely disposed from lotion applicator housing end 149. Handle assembly 150 has first handle section 152 and second handle section 154. Second handle section 154 can be folded next to first handle section 152 as depicted in FIG. 5 or second handle section 154 can be extended as depicted in FIG. 6. In so doing, handle assembly 150 in communication with housing 140 can be used to apply lotion to difficult-to-reach locations on a body. Thus, handle assembly 150 provides a contact means for the lotion applicator assembly 100 to perform on difficult-to-reach locations on a body.

In a preferred form, first handle section 152 and second handle section 154 have a slight arc for ease of application. The folding provides for ease of storage and transportation of the lotion applicator assembly 100.

For convenience in transporting or storing lotion applicator assembly 100, first handle section 152 and second handle section 154 can be folded together and placed on top of housing 140 as depicted in FIG. 1. FIG. 4 also shows that side housing panel 141 shown in FIG. 1 can be removed from housing 140 in order for lotion 400 to be placed into housing 140.

Aiding the storage, transportation and use of lotion applicator assembly 100, outer applicator roll cover 147 can be placed over outer applicator roll 160 as depicted in FIG. 1 or removed to expose applicator roll 160 as depicted in FIG. 2 removing roll cover 147 prevents unwanted transfer of lotion 400 present on outer applicator roll 160 to any undesired surfaces such as the inside of a pocket, purse or suitcase.

This application; taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person has made careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A lotion applicator assembly for applying a lotion evenly to a skin of a person with the lotion having at least minimal contact with at least one hand of the person, comprising:

(a) the lotion applicator assembly having a housing;

(b) the housing supporting a lotion mixing and moving means;

(c) the housing having a lotion supply chamber at a handle housing end;

(d) the housing having a dispensing means at a dispenser housing end;

(e) the handle housing end being oppositely disposed from the dispenser housing end;

(f) the lotion mixing and moving means communicating with the lotion supply chamber and the dispensing means;

(g) the lotion mixing and moving means being a continuous belt;

(h) the dispensing means being an outer applicator roll; and (i) a gear assembly connecting the outer applicator roll and the continuous belt.

2. The lotion applicator assembly of claim 1 further comprising:

(a) the outer applicator roll having a fixed position and a rotating position;

(b) the fixed position serving to spread the lotion; and (c) the rotating position serving to accomplish one procedure selected from the group consisting of receiving the lotion from the continuous belt, moving the continuous belt, mixing the lotion and spreading the lotion on a surface.

3. The lotion applicator assembly of claim 2 further comprising:

(a) the continuous belt serving to convey the lotion to the roller;

(b) the continuous belt serving to efficiently remove the lotion from the housing; and (c) the handle housing end including a handle.

4. The lotion applicator assembly of claim 3 further comprising:

(a) the handle being a foldable handle;

(b) the foldable handle having at least two sections; and (c) the foldable handle being adapted for extension or folding next to the housing.

5. The lotion applicator assembly of claim 3 further comprising:

(a) the housing having the outer applicator roll and an inner applicator roll cooperating therewith;

(b) the inner applicator roll providing a belt moving means for the continuous belt; and (c) the outer applicator roll and the inner applicator roll being connected together by the gear assembly.

6. The lotion applicator assembly of claim 5 further comprising:

(a) the outer applicator roll being slidably and rotatably mounted on an outer roll housing stub;

(b) the inner applicator roll being rotatably mounted on an inner roll housing stub; and (c) the gear assembly causing the inner applicator roll to rotate when the outer applicator roll rotates.

7. The lotion applicator assembly of claim 6 further comprising:

(a) the gear assembly including an outer roll gear mounted and an inner roll gear;

(b) the outer roll gear being mounted on the outer applicator roll;

(c) the inner roll gear being mounted on the inner applicator roll; and (d) the outer roll gear communicating with the inner roll gear, to provide that the inner applicator roll rotates as the outer applicator roll rotates.

8. The lotion applicator assembly of claim 7 further comprising:

(a) a inner roll housing stub being mounted in housing to support the inner applicator roll and permit rotation thereof;

(b) a roller bearing communicating with the continuous belt and the continuous belt communicating with the inner applicator roll;

(c) the roller bearing having roller bearing aperture therein; and (d) the roller bearing aperture receiving a housing shaft to support the continuous belt.

9. The lotion applicator assembly of claim 8 further comprising:

(a) the inner applicator roll including a set of slots thereon;

(b) the drive continuous belt having fingers thereon; and (c) the slots meshing with the fingers to assist movement of the continuous drive belt.

10. The lotion applicator assembly of claim 9 further comprising:

(a) the outer applicator roll being mounted in a roll slot;

(b) the roll slot having a lock portion and a rotating portion;

(c) the lock portion preventing rotation of the outer applicator roll, thereby permitting a smearing of lotion;

(d) the rotating portion allowing the outer applicator roll to rotate about a cylindrical axis and spread or apply lotion; and (e) the outer applicator roll being slidably mounted between the lock portion and the rotating portion.

11. A liquid applicator assembly for applying a liquid substantially evenly to a desired surface with the liquid having at least minimal contact with at least one hand of the person, comprising:

(a) the liquid applicator assembly having a housing;

(b) the housing supporting a liquid mixing and moving means;

(c) the housing having a liquid supply chamber at a handle housing end;

(d) the housing having a dispensing means at a dispenser housing end;

(e) the handle housing end being oppositely disposed from the dispenser housing end;

(f) the liquid mixing and moving means communicating with the liquid supply chamber and the dispensing means;

(g) the liquid mixing and moving means being a continuous belt;

(h) the dispensing means being an outer applicator roll; and (i) a gear assembly connecting the outer applicator roll and the continuous belt.

12. The lotion applicator assembly of claim 11 further comprising:

(a) the outer applicator roll having a fixed position and a rotating position;

(b) the fixed position serving to spread the liquid; and (c) the rotating position serving to accomplish one procedure selected from the group consisting of receiving the liquid from the continuous belt, moving the continuous belt, mixing the liquid and spreading the liquid on a surface.

13. The lotion applicator assembly of claim 12 further comprising:

(a) the continuous belt serving to convey the liquid to the roller;

(b) the continuous belt serving to efficiently remove the liquid from the housing;

(c) the handle housing end including a handle; and (d) the handle providing a contact means for the roller to reach a desired area.

14. The liquid applicator assembly of claim 13 further comprising:

(a) the housing having the outer applicator roll and an inner applicator roll cooperating therewith;

(b) the inner applicator roll providing a belt moving means for the continuous belt; and (c) the outer applicator roll and the inner applicator roll being connected together by the gear assembly.

* * * * *